US005285240A

United States Patent [19]

Kinoshita et al.

[11] Patent Number: 5,285,240

[45] Date of Patent: Feb. 8, 1994

[54] IMAGE FORMING MACHINE COMPRISING THREE SEPARABLE FRAMES WITH OPENING/CLOSING MECHANISMS BETWEEN EACH FRAME

[75] Inventors: Yoshiya Kinoshita, Ikoma; Kouichi Yamauchi, Yamatokoriyama, both of Japan

[73] Assignee: Sharp Kabushiki Kaisha, Osaka, Japan

[21] Appl. No.: 885,487

[22] Filed: May 19, 1992

[30] Foreign Application Priority Data

May 20, 1991 [JP] Japan ..... 3-115010

[51] Int. Cl.[5] ..... G03G 15/00

[52] U.S. Cl. ..... 355/200; 355/211

[58] Field of Search ..... 355/200, 210, 211, 260; 346/160

[56] References Cited

U.S. PATENT DOCUMENTS 4,873,548 1/1989 Kobayashi et al. ..... 355/200

4,908,659 3/1990 Ishii et al. ..... 355/200

FOREIGN PATENT DOCUMENTS 61-50296 4/1986 Japan .

*Primary Examiner*—A. T. Grimley

*Assistant Examiner*—Shuk Y. Lee

*Attorney, Agent, or Firm*—David G. Conlin; George W. Neuner

[57] ABSTRACT

Opening/closing mechanisms for an image formation apparatus is provided to facilitate operations for exchange of, e.g., a fixing unit and paper jam. To exchange the fixing unit, a releasing lever 99*a* allows a pressing strip 55 to pivot a contact maker 67 of the first opening/closing mechanism X1 and pivot a pivoting member 65. Thus, a contact pad 71 can release an upper coupling strip 61 from a pin 62 of an intermediate frame 23, and an upper frame 24 can be independently opened. To remove a jammed paper, a switch lever 103*b* allows the pressing strip 55 to move horizontally. Thereafter, the pressing strip 55 is contacted with a lower releasing strip 54 of the second opening/closing mechanism X2 in response to operation of the releasing lever 99*a*. Thus, an engaging member 83 is released from a pin 81 of a lower frame 21 so that the upper frame 24 is released from the intermediate frame 23. Further, the contact maker 67 of the first opening/closing mechanism X1 is lowered by a spring 74, and transferred below a movement locus of the pressing strip 55. Therefore, the intermediate frame 23 never drops even if the releasing lever 99*a* is operated.

2 Claims, 16 Drawing Sheets

IMAGE FORMING MACHINE COMPRISING THREE SEPARABLE FRAMES WITH OPENING/CLOSING MECHANISMS BETWEEN EACH FRAME

BACKGROUND OF THE INVENTION (1) Field of the Invention

The present invention relates to an image formation apparatus, such as a laser beam printer or copying machine having a fixing unit which is removably provided for the apparatus body. (2) Description of the Prior Art In an image formation apparatus such as a copying machine having a fixing unit removably provided for the apparatus body, a frame mechanism is well-known to separate one frame from another vertically for various purposes. The mechanism has been proposed, for example, in Japanese Utility Model Application Laid-Open No. 61-50296.

Such a conventional copying machine is constructed as shown in FIGS. 1 and 2. Namely, an image formation apparatus body 1 includes a fixing unit removably provided therein, and comprises a lower frame 2 and an upper frame 4 which is pivotally supported about a spindle 3 to open and close with respect to the lower frame 2.

The upper frame 4 comprises a photosensitive drum unit 6 and developer unit 7 serving as image formation units 5, which are removably mounted on the upper frame 4. The upper frame 4 further comprises an optical unit 8 above the image formation units 5.

The lower frame 2 comprises a fixing unit 9 removably mounted on the lower frame 2, a transfer paper cassette 10, a feed route 14 to feed a paper through a charge transferring unit 13 to the fixing unit 9, and an ejection route 17 to eject the paper through an ejection roller 15 to a tray 16.

The respective image formation units 5, i.e., the photosensitive drum unit 6, the developer unit 7 and the fixing unit 9 are consumable, and should be exchanged. For exchange of these units, the frame 4 is pivotally opened about the spindle 3 with respect to the lower frame 2 in response to operation of an opening/closing lever 18 mounted on the upper frame 4. In this condition, the photosensitive drum unit 6 and developer unit 7 can be pulled out of the upper frame 4, and exchanged. The fixing unit 9 in the lower frame 2 can be also pulled up to exchange. When a paper jam occurs, the upper frame 4 is opened as in the case of the exchange so that a jammed transfer paper 11 is removed out of the feed route 14 or ejection route 17 on the lower frame 2.

However, there are several drawbacks if exchange the image formation units 5 with the upper frame 4 opened. First, the upper frame 4 is not rigidly supported so that instability of the upper frame 4 prevents easy exchange operation.

In addition, it is difficult to pull the fixing unit 9 out of the lower frame 2 due to a small open angular between the upper and lower frames 4, 2. If the open angular becomes greater, some other problems occur. Namely, toner is spilled out of the developer unit 7 of the upper frame 4 and makes the frames below dirty. A mechanism for maintaining the opened condition, such as a strong spring assembly or lock mechanism, complicates a construction of the apparatus. Further, when pulling up the fixing unit 9 and upper frame 4 at the same time, sufficient stability of the image formation apparatus body 1 might be lost because center of gravity of the apparatus is transferred toward the back of the upper frame 4.

SUMMARY OF THE INVENTION

In view of the problems set forth above, it is an object of the present invention to provide an image formation apparatus which facilitates each operation for exchange of, for example, a fixing unit or occurrence of paper jam in response to the respective opened conditions according to the respective operations.

An image formation apparatus of the invention comprises an image formation apparatus body including:

a lower frame having a transfer paper carrying route and a removable fixing unit;

an upper frame pivotably supported about a spindle to open and close with respect to the lower frame; and an intermediate frame pivotably supported about the spindle between the upper frame and the transfer paper carrying route, and having removable image formation units; the image formation apparatus further comprising:

a first opening/closing mechanism for opening and closing the upper frame with respect to the intermediate frame; and a second opening/closing mechanism for opening and closing the intermediate frame with respect to the lower frame;

the first opening/closing mechanism including an upper coupling strip for coupling the upper frame with the intermediate frame, and an upper releasing means for releasing the upper frame from the intermediate frame in response to contact with the upper coupling strip;

the second opening/closing mechanism including a lower coupling means for coupling the lower frame with the intermediate frame, and a lower releasing strip for releasing the lower frame from the intermediate frame in response to contact with the lower coupling means;

the upper releasing means and the lower releasing strip horizontally disposed in parallel with each other;

the upper frame having a shared pressing strip actuating the upper releasing means and lower releasing strip;

the pressing strip movably mounted in the direction to actuate the respective opening/closing mechanisms, and being switchable between a first press position to press the upper releasing means and a second press position to press the lower releasing strip; and a switch mechanism for switching the press strip to one of two positions.

Effectively, the upper releasing means of the first opening/closing mechanism comprises:

a holder vertically movably mounted on the intermediate frame and downwardly projecting in response to a spring when the intermediate frame is released; and a contact maker pivotably supported about an axis by the holder and actuating the upper coupling strip in the uncoupling direction in response to press motion of the pressing strip, the contact maker is transferred below a movement locus of the pressing strip when the intermediate frame is released from the lower frame.

In the image formation apparatus having the above construction according to the invention, when exchange a consumable fixing unit, the switch mechanism horizontally transfers the pressing strip to a position corresponding to the upper releasing means. Thus, upper releasing means releases the upper coupling strip, and allows to independently pivot the upper frame at right angle to open. The fixing unit comes in sight and can be pulled out of the image formation apparatus to exchange for a new part.

When paper jam occurs in the paper carrying route during image formation, the switch mechanism actuates the pressing strip to move horizontally to a position corresponding to the lower releasing strip. Thus, lower releasing strip releases the lower coupling means. A jammed transfer paper can be removed out of the exposed paper carrying route after pulling up the upper frame coupled with the intermediate frame at approximately 30 degrees.

As noted above, the intermediate frame can be alternatively coupled with one of the upper and lower frames according to the respective operations. Therefore, operations can be very easily performed.

Moreover, the upper releasing means is vertically movably mounted in the intermediate frame. Consequently, when the intermediate frame coupled with the upper frame is pulled and separated from the lower frame, the upper releasing means can be transferred below the movement locus of the pressing strip to avoid contacting with the pressing strip. As a result, it is possible to avoid the danger of the intermediate frame dropping during operation on the paper carrying route.

DESCRIPTION OF THE PREFERRED EMBODIMENTS

Figure 1:
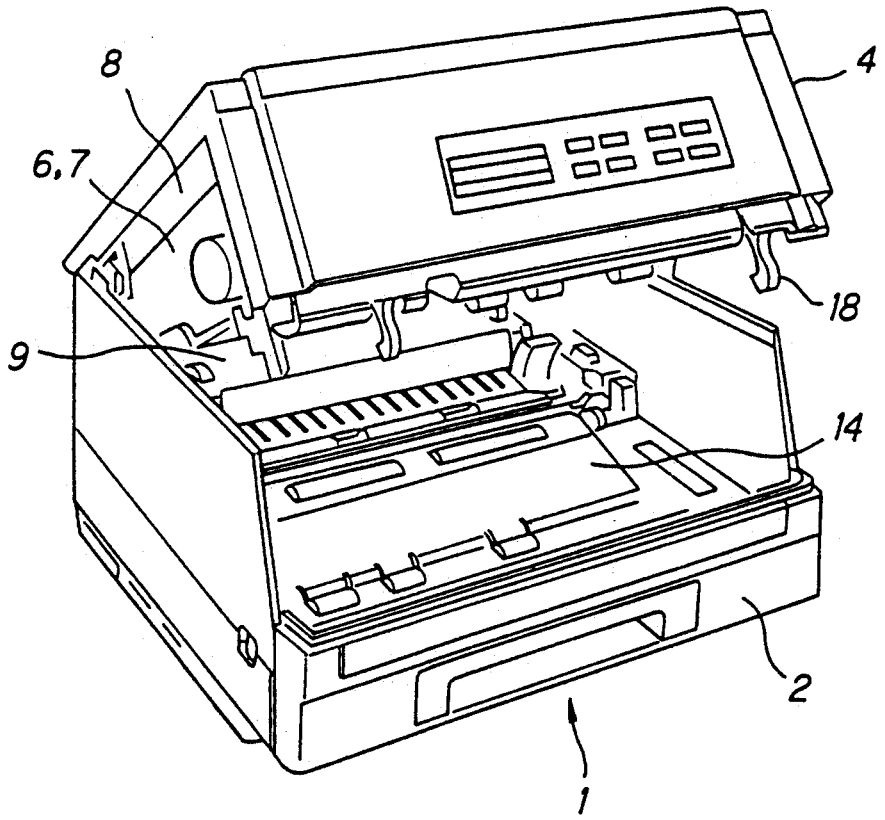
Fig. 1 PRIOR ART
FIG. 1 is an external perspective overall construction of a conventional image formation apparatus.
Figure 2:
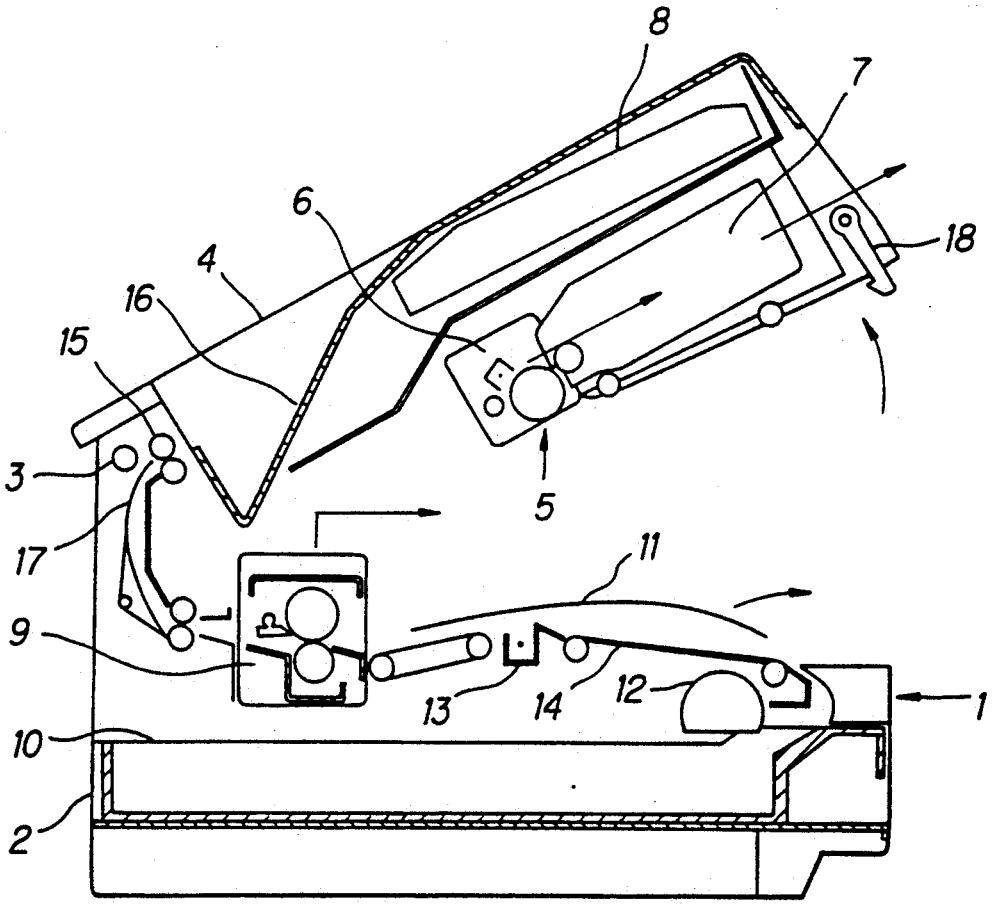
Fig. 2 PRIOR ART
FIG. 2 is a sectional view of the conventional image formation apparatus.

The present invention will be explained in detail with reference to the drawings. Elements will be identified using the same reference numerals as their corresponding counterparts in the conventional embodiment.

FIGS. 3 through 18 show an image formation apparatus according to an embodiment of the invention. The image formation apparatus body 1 comprises a lower frame 21 having a transfer paper carrying route 20 and removable fixing unit 9, an upper frame 24 pivotally supported about a spindle 22 on the lower frame 21 to open and close, and an intermediate frame 23 mounted between the upper frame 24 and the transfer paper carrying route 20, and having image formation units 5. The image formation apparatus body 1 further comprises a first opening/closing mechanism X1 to open and close the upper and intermediate frames 24, 23, and a second opening/closing mechanism X2 to open and close the intermediate and lower frame 23, 21.

Figure 3:
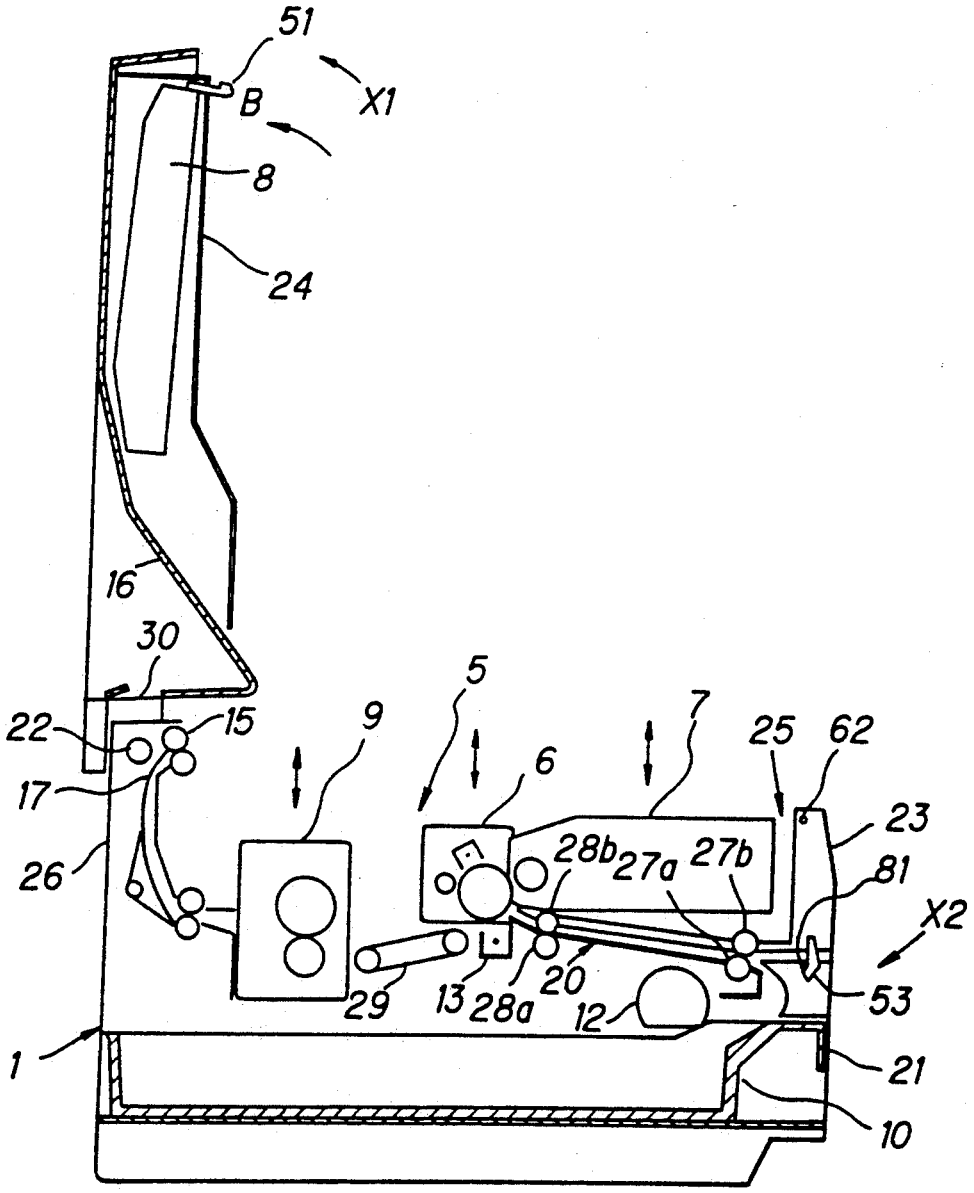
FIG. 3 is a sectional view illustrating a preferred embodiment of an image formation apparatus according to the present invention when exchanging a fixing unit.
Figure 4:
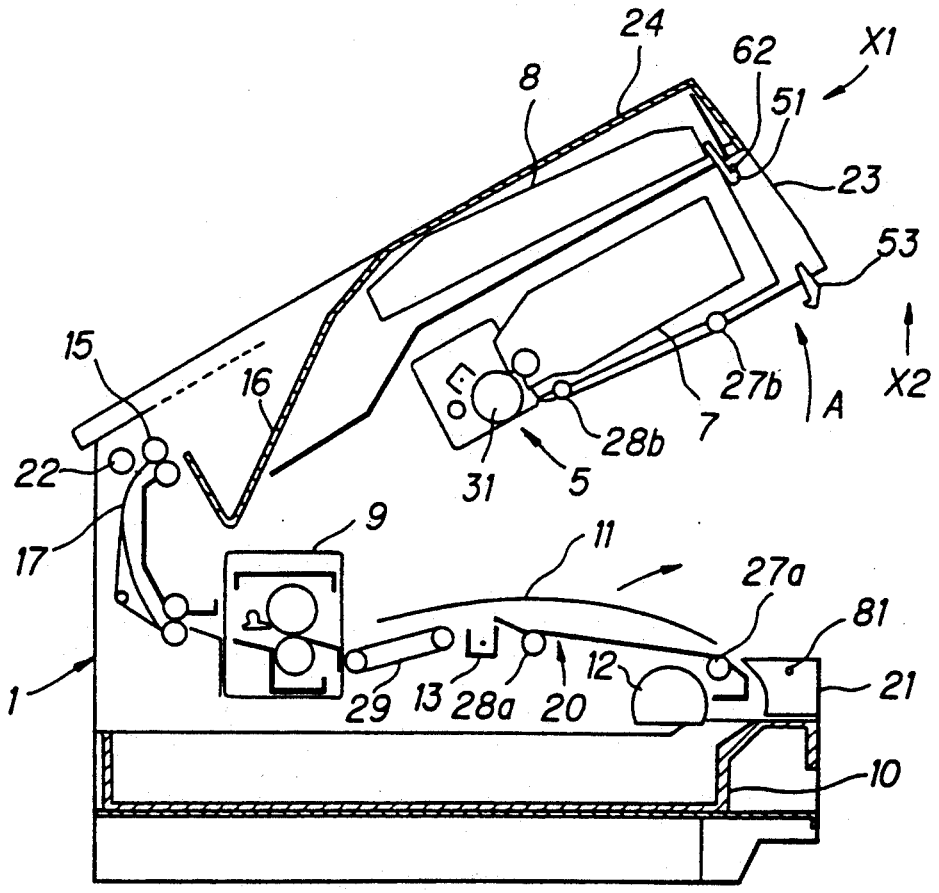
FIG. 4 is a sectional view of the image formation apparatus during action for paper jam.
Figure 18:
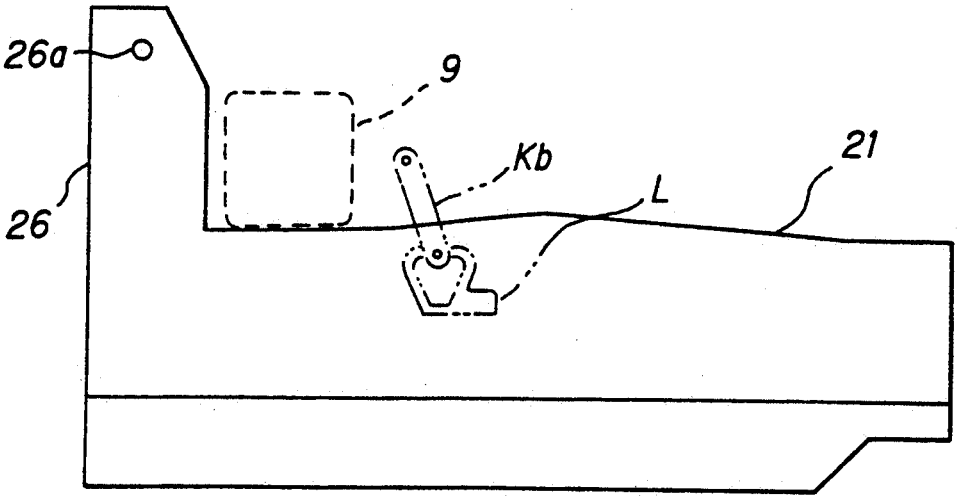
FIG. 18 is a side view of a lower frame of the image formation apparatus.

As shown in FIG. 18, the lower frame 21 has a substantially rectangular parallelepiped configuration. The lower frame 21 is provided with a supporting strip 26 projecting upwardly at the back thereof. A hole 26*a* is provided in the upper position of the supporting strip 26 to fit the spindle 22 in the hole 26*a*. As shown in FIGS. 3 and 4, the lower frame 21 includes, from the front to the rear, lower carrying rollers 27*a* and 28*a*, a charge transferring unit 13, a carrying belt 29, a fixing unit 9, and an ejection roller 15 in that order on the upper surface of the lower frame 21. At the lower position of the lower frame 21, a paper cassette 10 for a transfer paper 11 is removably mounted, and a feed roller 12 is arranged above the paper cassette 10. Further, a route passing through the feed roller 12 to ejection roller 15 is defined as the transfer paper carrying route 20.

Figure 17:
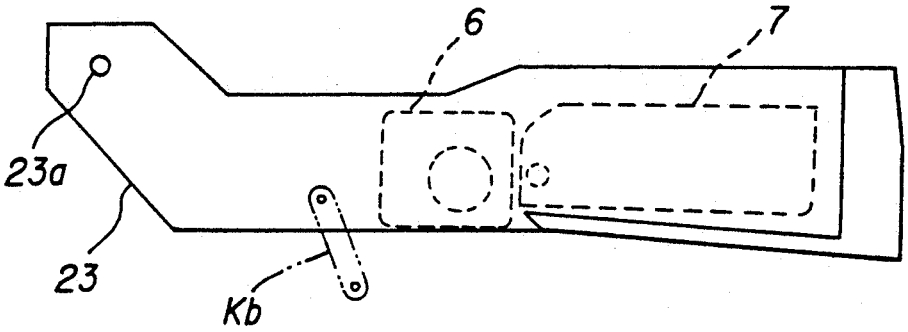
FIG. 17 is a side view of an intermediate frame of the image formation apparatus.

The intermediate frame 23 is a frame body as shown in FIG. 17, having guide rails (not shown) to mount a photosensitive drum unit 6 and developer unit 7 into the frame body from the upper direction. A hole 23*a* is provided in the back end of the intermediate frame 23 for rotatably fitting the spindle 22 in the hole 23*a*. The intermediate frame 23 has upper carrying rollers 27*b*, 28*b* opposed to the lower carrying rollers 27*a*, 28*a* of the lower frame 21 as shown in FIGS. 3 and 4. As shown in FIG. 17, a restricting lever Kb is disposed between the intermediate frame 23 and lower frame 21 to avoid a reduced open angular between the intermediate and lower frames 23, 21 due to, for example, a weaken spring. Thus, the restricting lever Kb can fix the intermediate frame 23 inclined at approximately 30 degrees to the lower frame 21. As shown in FIG. 18, notation L depicts a rail to control a movement range of the lower end of the restricting lever Kb.

Figure 16:
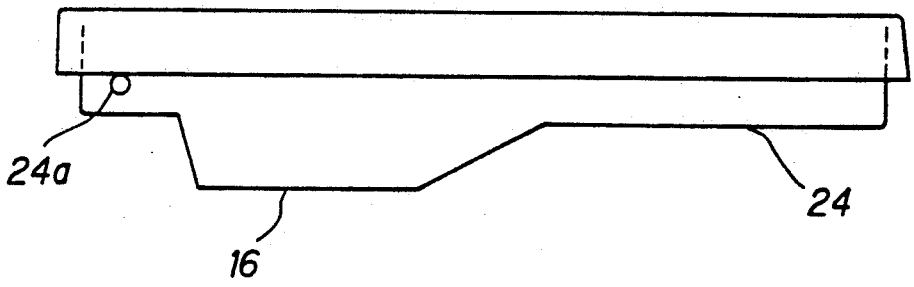
FIG. 16 is a side view of an upper frame of the image formation apparatus.

The upper frame 24 has a substantially rectangular parallelpiped configuration as shown in FIGS. 3, 4, and 16. The upper frame 24 is provided with an opening 30 in the rear side of the upper frame 24. The transfer paper 11 passes through the opening 30 after ejected through the ejection roller 15 of the lower frame 21. A concave tray 16 is mounted in front of the opening 30 on the upper frame 24. A hole 24a is provided in the back end of the upper frame 24 for rotatably fitting the spindle 22 in the hole 24a. An optical unit 8 is housed in the upper frame 24 on this side of the tray 16. The upper frame 24 can be pivoted up to at approximately right angle to the lower frame 21 in response to a spring (not shown) mounted in the spindle 22.

Figure 6:
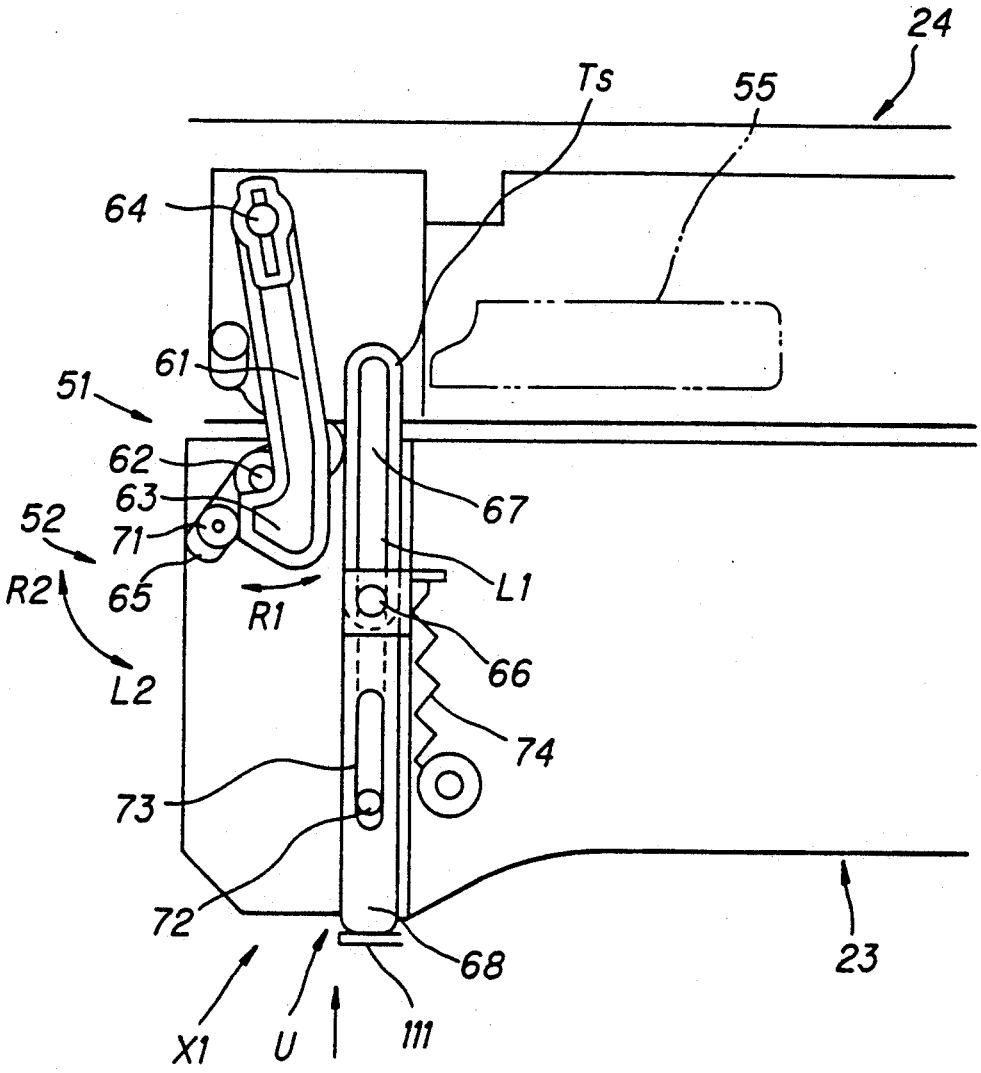
FIG. 6 is an essential sectional view illustrating the image formation apparatus with an upper coupling strip coupled.
Figure 7:
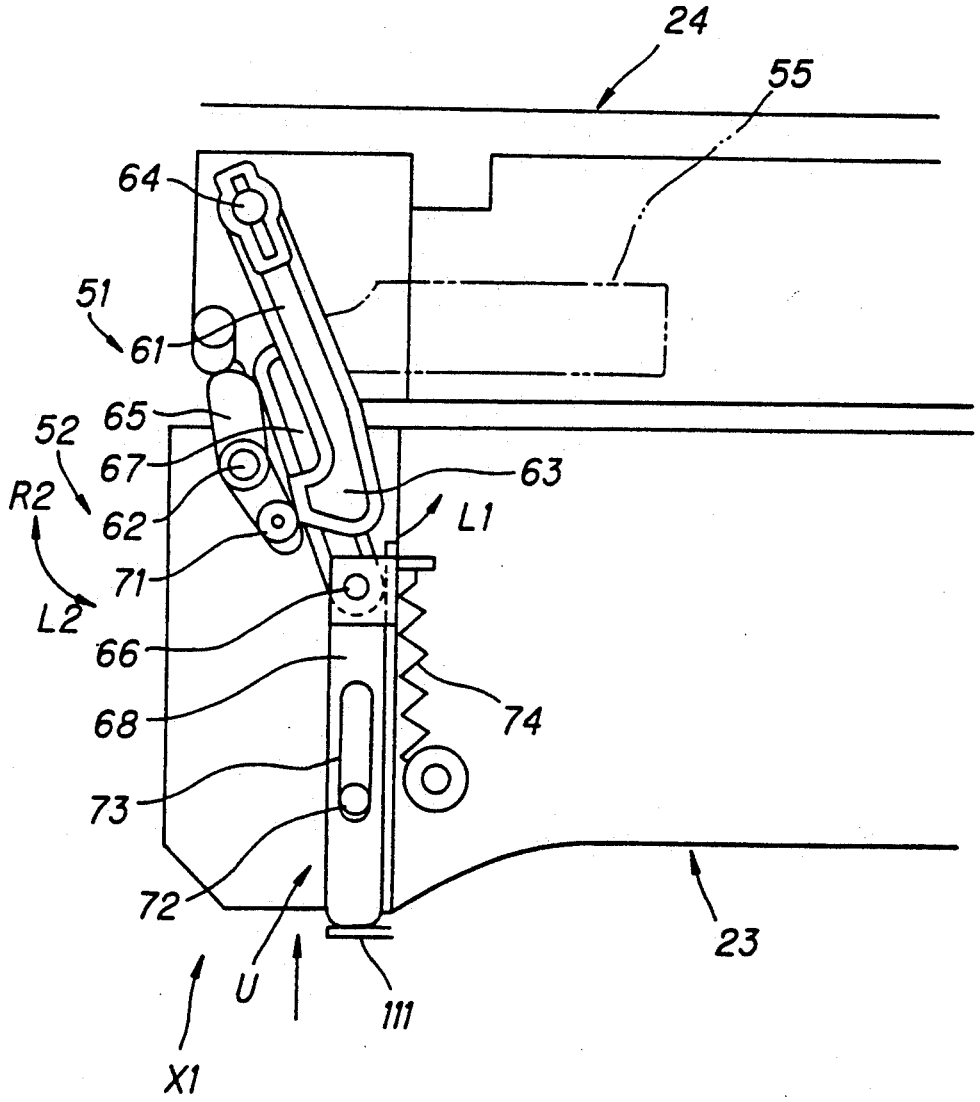
FIG. 7 is an essential sectional view illustrating the image formation apparatus with the upper coupling strip released.
Figure 8:
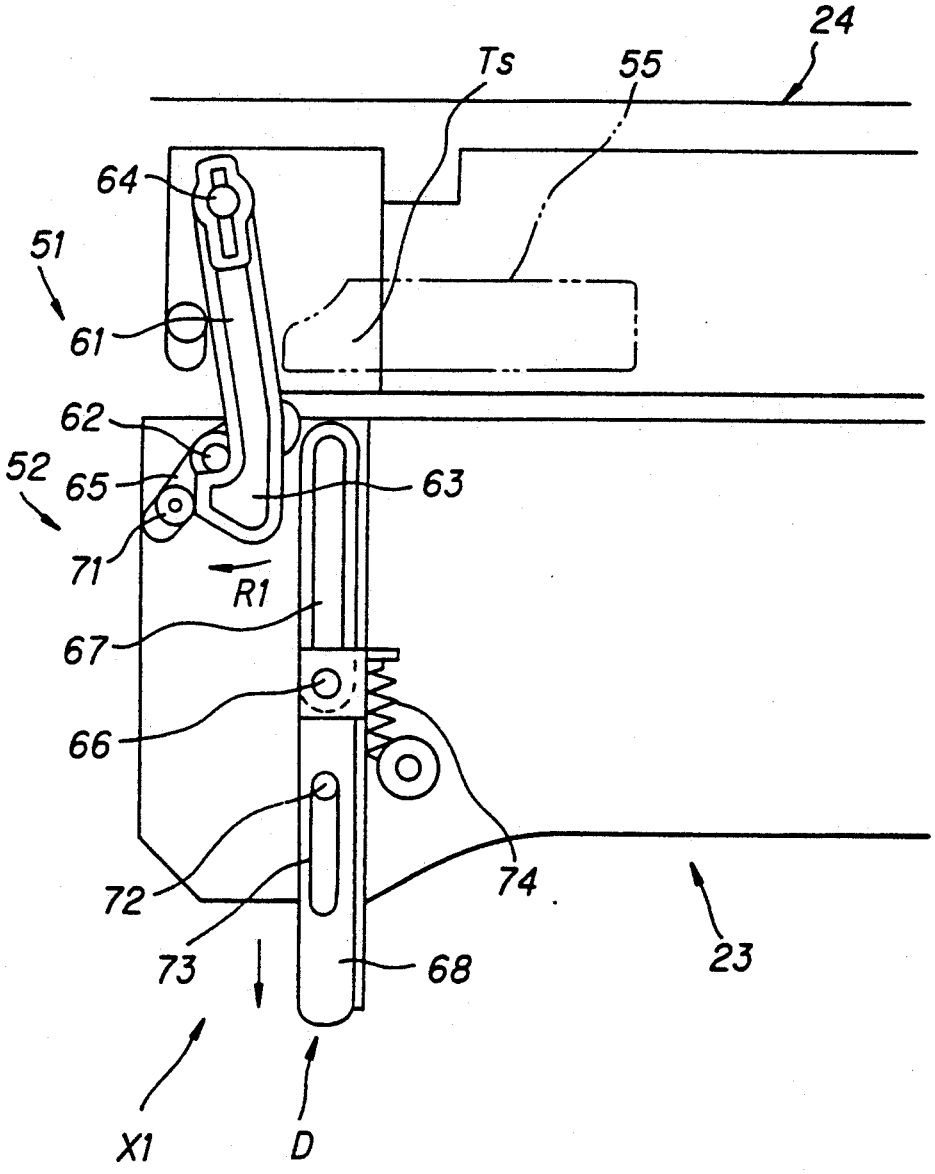
FIG. 8 is an essential sectional view illustrating the image formation apparatus with the upper releasing means downwardly transferred during action for paper jam.

The first opening/closing mechanism X1 comprises, as shown in FIGS. 6 through 8, an upper coupling strip 51 for connecting the upper frame 24 with the intermediate frame 23, and an upper releasing means 52 for releasing the upper frame 24 from the intermediate frame 23 in response to contact with the upper coupling strip 51.

The upper coupling strip 51 comprises a coupling body 61 and an engaging claw 63 for engaging with a pin 62 laterally provided in the intermediate frame 23 at the lower end of the coupling body 61. The upper end of the coupling body 61 is pivotably supported about a lateral axis 64 on the upper frame 24. The upper coupling strip 51 is generally spring-loaded in the coupling direction R1 to be coupled with the pin 62 by, for example, a spring (not shown).

The upper releasing means 52 comprises a pivoting member 65, a contact pad 71, and a contact maker (protect lever) 67. The substantially L-shaped pivoting member 65 is pivotably supported by the pin 62 secured to the intermediate frame 23. The contact pad 71 projects from the lower end of the pivoting member 65, and contacts with the engaging claw 63 of the upper coupling strip 51 to push and release the engaging claw 63 from the pin 62 in the uncoupling direction L1. The contact maker 67 is pivotably supported about a lateral axis 66 at the upper end of a holder 68 of the intermediate frame 23. The contact maker 67 is pivoted by a pressing strip 55 as described later to contact with the pivoting member 65 and pivot the pivoting member 65 in the uncoupling direction L2.

A mechanism is further provided to avoid the intermediate frame 23 falling from the upper frame 24 when the intermediate frame 23 coupled with the upper frame 24 is pulled and separated from the lower frame 21. The construction of the release prevention mechanism will be described hereinafter. The holder 68 comprises a longitudinal slit 73 in the intermediate portion thereof. A lateral pin 72 secured to the intermediate frame 23, passes through the slit 73, whereby providing vertical movable guidance for the holder 68 with respect to the intermediate frame 23. The holder 68 is downwardly loaded by a spring 74. Consequently, when the intermediate frame 23 is released from the lower frame 21, the contact maker 67 can be downwardly moved and positioned according to moving trail of the pressing strip 55.

The second opening/closing mechanism X2 comprises a lower coupling means 53 for coupling the lower frame 21 with the intermediate frame 23, and a lower releasing strip 54 for releasing the lower frame 21 from the intermediate frame 23 in response to contact with the lower coupling means 53.

Figure 9:
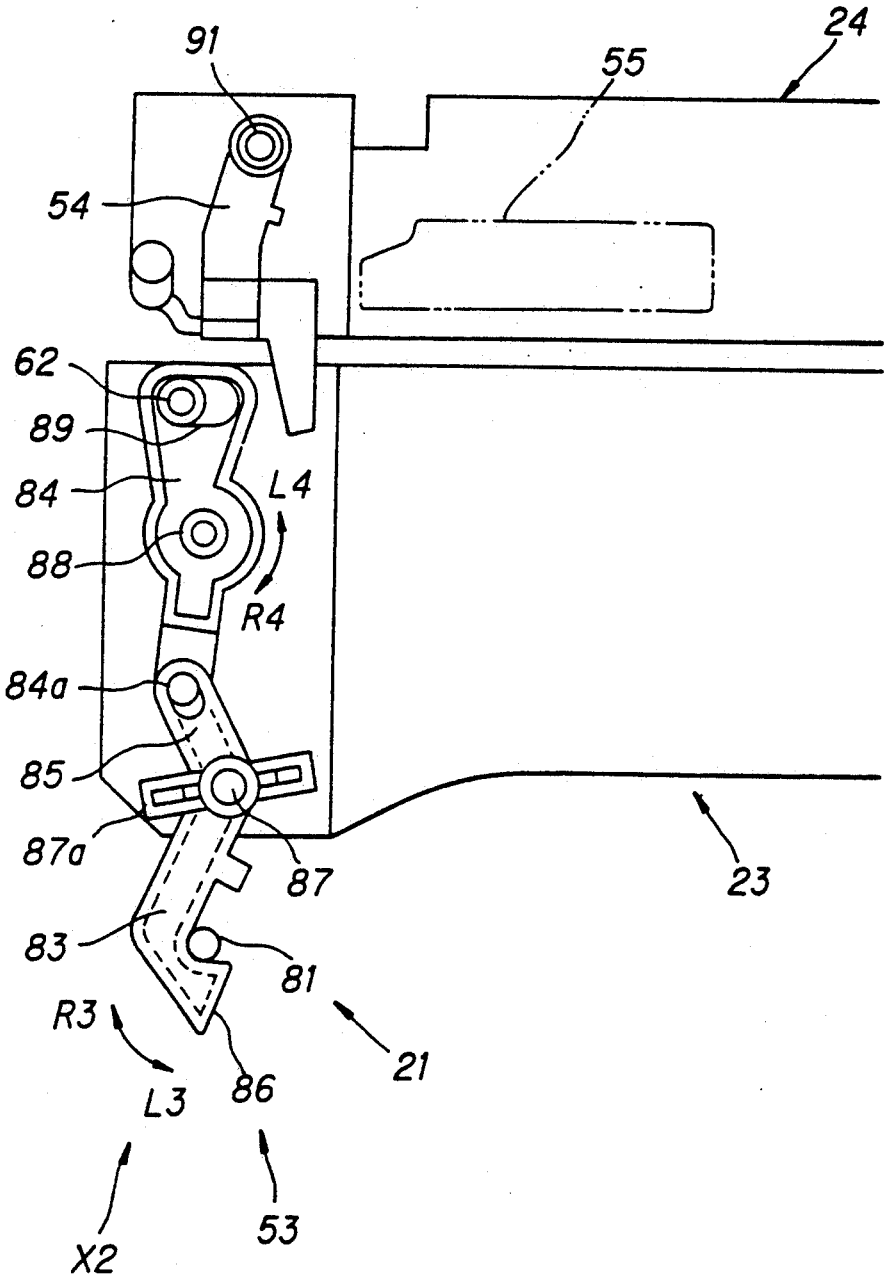
FIG. 9 is an essential sectional view illustrating the image formation apparatus with a lower coupling means coupled.
Figure 10:
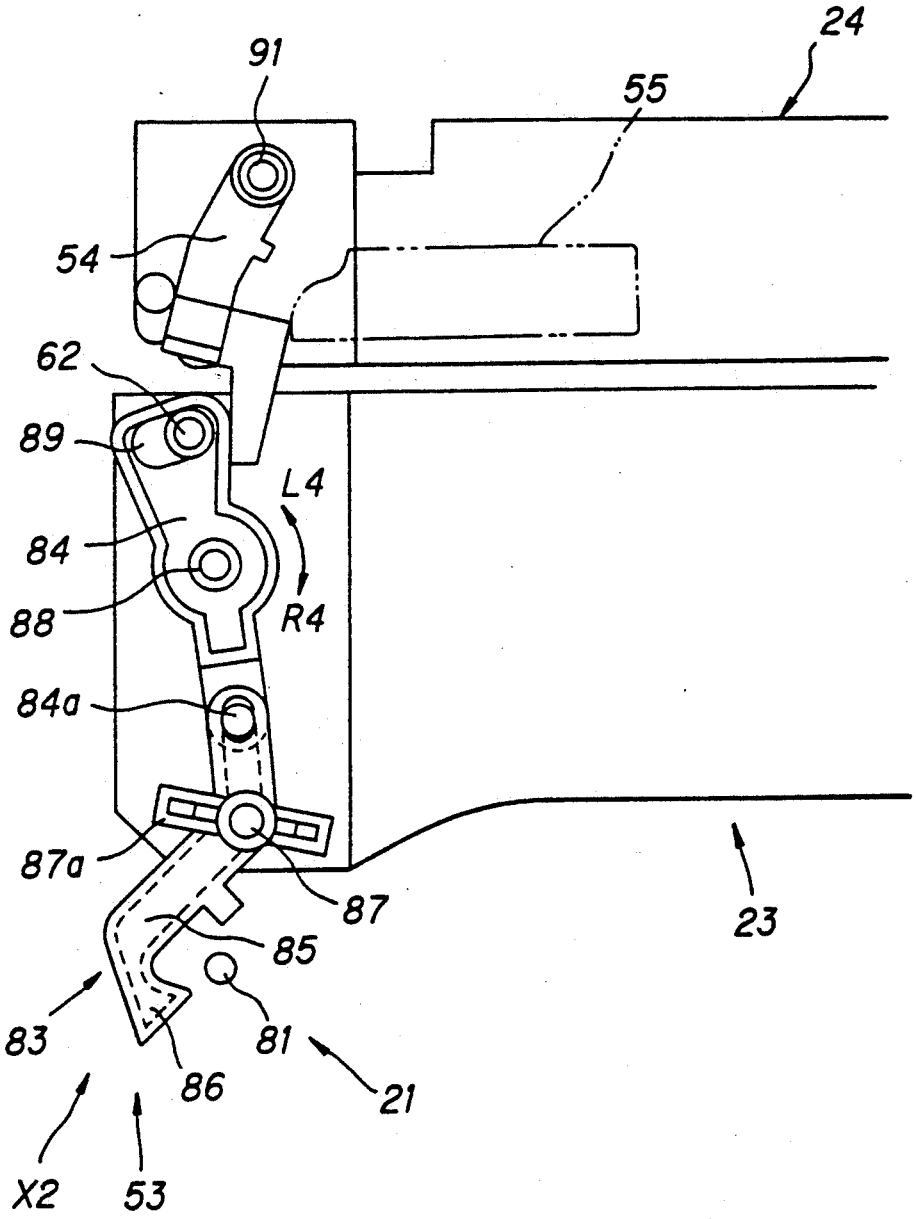
FIG. 10 is an essential sectional view illustrating the image formation apparatus with the lower coupling means released.
Figure 11:
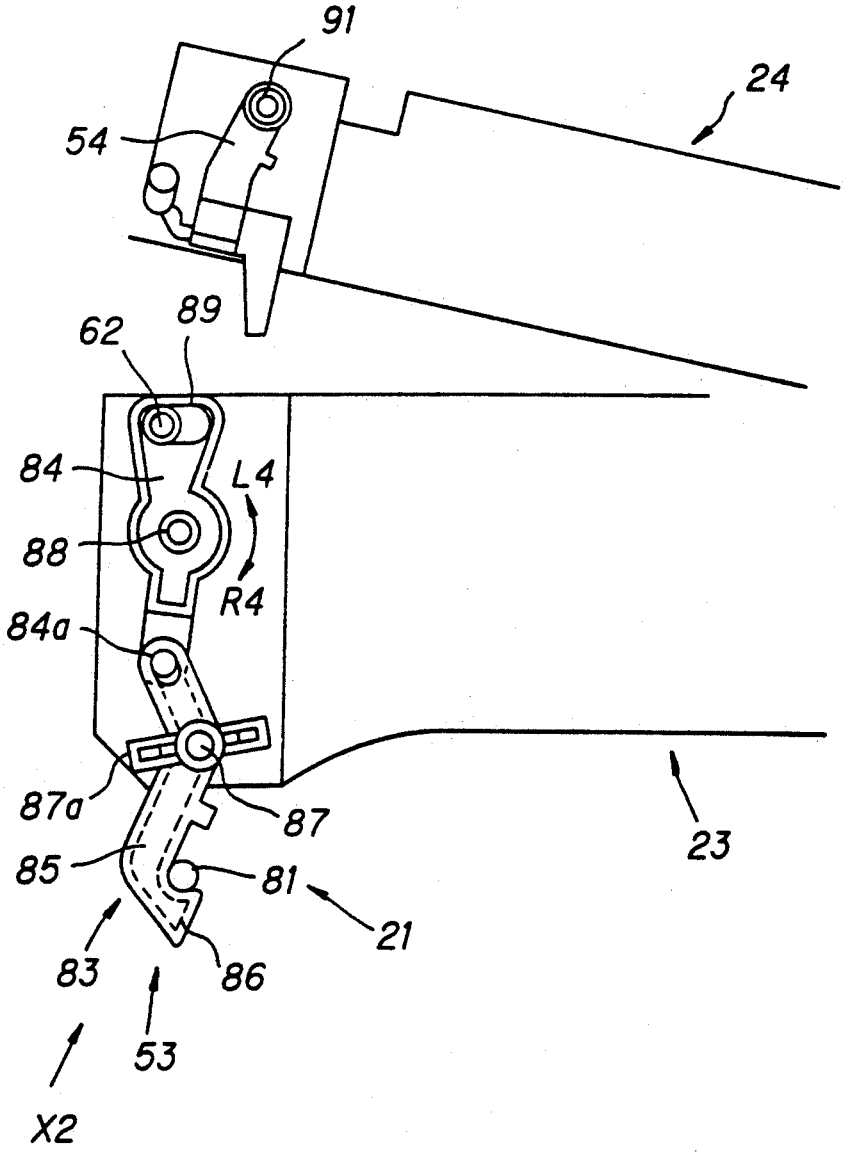
FIG. 11 is an essential sectional view illustrating the image formation apparatus with the lower releasing strip separated from the lower coupling means when exchanging the fixing unit.

As shown in FIGS. 9 through 11, the lower coupling means 53 comprises an engaging member 83 for engaging removably with a pin 81 laterally fixed in the lower frame 21, and a holder 84 having a pin 84a to pivotably hold the upper end of the engaging member 83.

The engaging member 83 comprises a substantially L-shaped engaging body 85, and an engaging claw 86 provided at the lower end of the engaging body 85 for engaging with the pin 81. The intermediate portion of the engaging body 85 is pivotably supported about a lateral axis 87 secured to the intermediate frame 23. The engaging member 83 is generally loaded in the coupling direction L3 by, for example, a spring (not shown) to engage the intermediate frame 23 with the lower frame 21. Reference numeral 87a in the figures depicts a slit for adjusting a position of the engaging member 83.

The holder 84 is pivotably supported about a lateral axis 88 secured to the intermediate frame 23 at the intermediate portion of the holder 84. A slit 89 is provided in the upper end of the holder 84. The pin 62 passes through the slit 89 to avoid excessive pivot of the holder 84. The holder 84 is generally spring-loaded by the engaging member 83 in the coupling direction R4.

The releasing strip 54 has a claw-like form, and the upper end of the releasing strip 54 is pivotably supported about a lateral axis 91 on the upper frame 24. When the upper frame 24 is independently released as shown in FIG. 11, the lower releasing strip 54 loses its releasing function in response to the separation of the lower releasing strip 54 from the lower coupling means 53.

Figure 5:
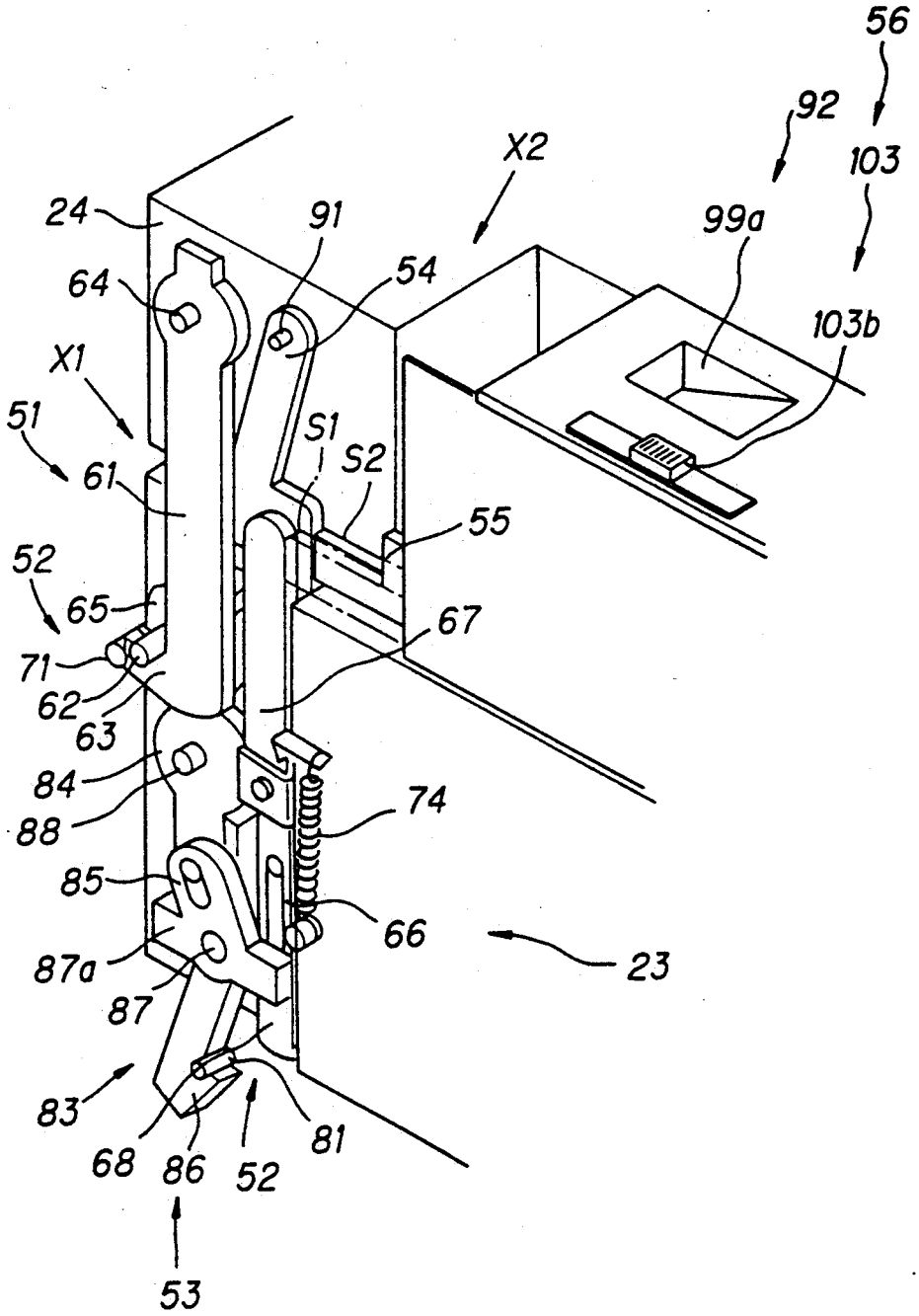
FIG. 5 is an enlarged perspective view in an essential part of the image formation apparatus.

The upper releasing means 52 and lower releasing means 54 are horizontally disposed in parallel with each other as shown in FIG. 5. As shown in FIGS. 12 through 15, the pressing strip 55 is provided for the upper frame 24 to actuate the upper and lower releasing means 52, 54, respectively. Namely, the pressing strip 55 is movable in the direction T to actuate the opening/closing mechanisms X1, X2. Further, the pressing strip 55 can be switched between the first press position S1 for pressing the upper releasing means 52 and the second press position S2 for pressing the lower releasing strip 54. A switching mechanism 56 switches the pressing strip 55 to one of two positions S1, S2.

Figure 12:
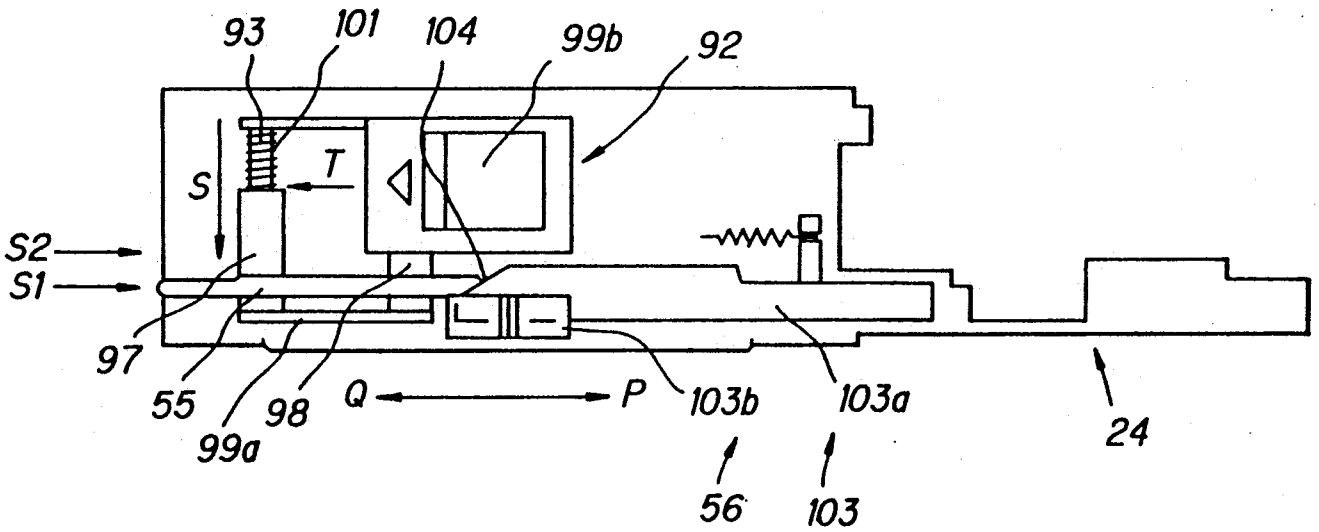
FIG. 12 is a planar sectional view illustrating the image formation apparatus with a pressing strip switched to the first press position by a switch mechanism.
Figure 13:
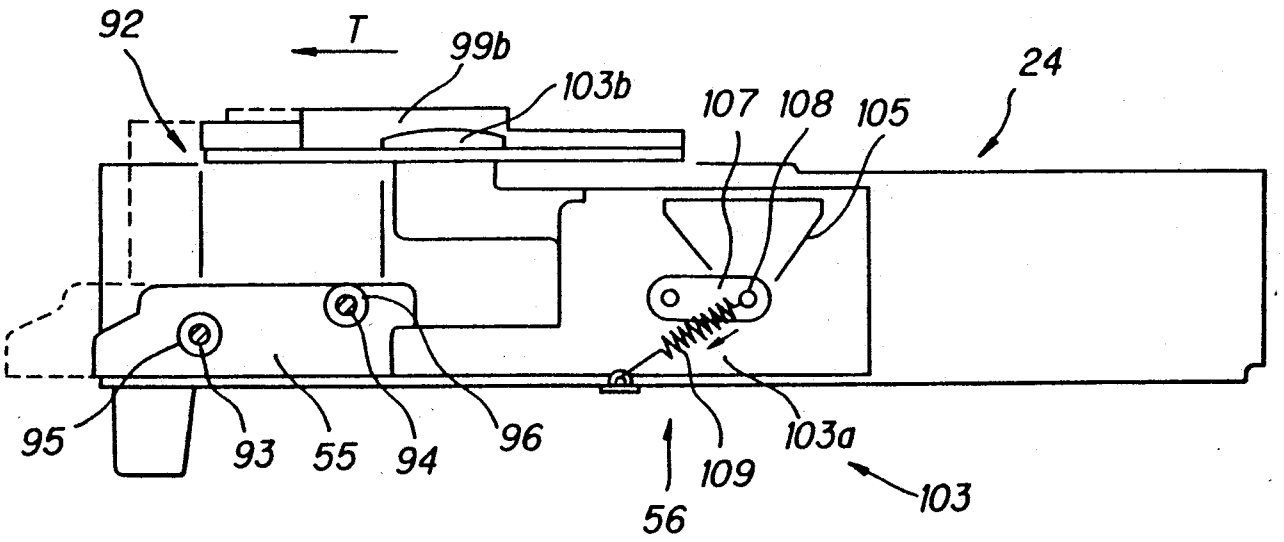
FIG. 13 is a side sectional view illustrating the image formation apparatus with a pressing strip switched to the first press position by a switch mechanism.
Figure 14:
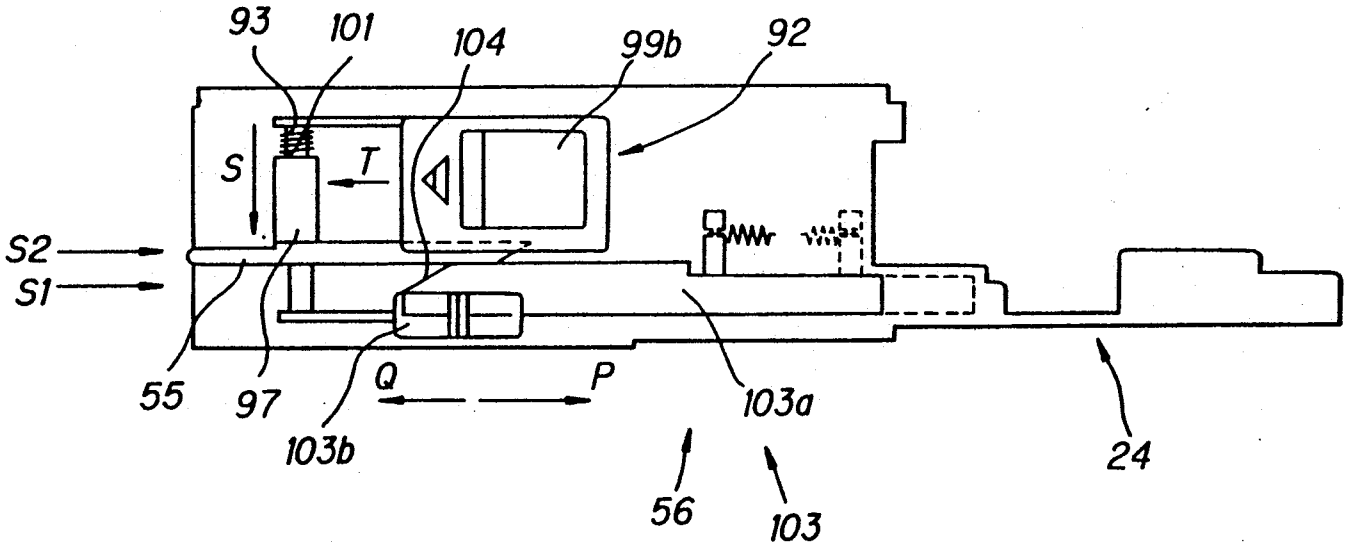
FIG. 14 is a planar sectional view illustrating the image formation apparatus with the lower coupling means switched to the second press position by the switch mechanism.

The pressing strip 55 serves as one component of an opening/closing lever unit 92, as shown in FIGS. 12 through 15, during opening the image formation apparatus body 1. The opening/closing lever unit 92 comprises a releasing lever 99, a pair of coupling plates 99b, a pair of lateral rods 93, 94, the pressing strip 55, coil springs 101. The releasing lever 99a is disposed at the end of the upper surface of the upper frame 24, and slidably guided in respective directions P and Q. A pair of the coupling plates 99b are secured to the releasing lever 99a. A pair of the lateral rods 93, 94 are disposed between the respective coupling plates 99b. The pressing strip 55 has two cylindrical portions 97, 98 through which the lateral rods 93 and 94 pass. The pressing strip 55 is mounted movably along the length of the rods 93, 94. The coil springs 101 are disposed between the coupling plates 99b and the cylindrical portions 97, 98. The opening/closing lever unit 92 is generally positioned at a predetermined position as shown in FIGS. 12 and 14 by, for example, a spring (not shown). Therefore, if, against the loaded spring, an operator moves the opening/closing lever unit 92 in the direction T, the pressing strip 55 moves toward the direction T to contact with and pivot the upper releasing means 52 and lower releasing strip 54.

The switch mechanism 56 comprises the spring 101 for loading the pressing strip 55 to the side of the first press position S1, and a switch lever 103 for moving the pressing strip 55 against the spring 101 to the side of the second press position S2.

The switch lever 103 has a taper surface 104 at a pointed end thereof. The taper surface 104 switches a position of the pressing strip 55 in response to contact with one end of the pressing strip 55. The switch lever 103 comprises a main lever 103*a* and manual control knob 103*b*, and can move in the both directions P and Q with respect to the upper frame 24.

Figure 15:
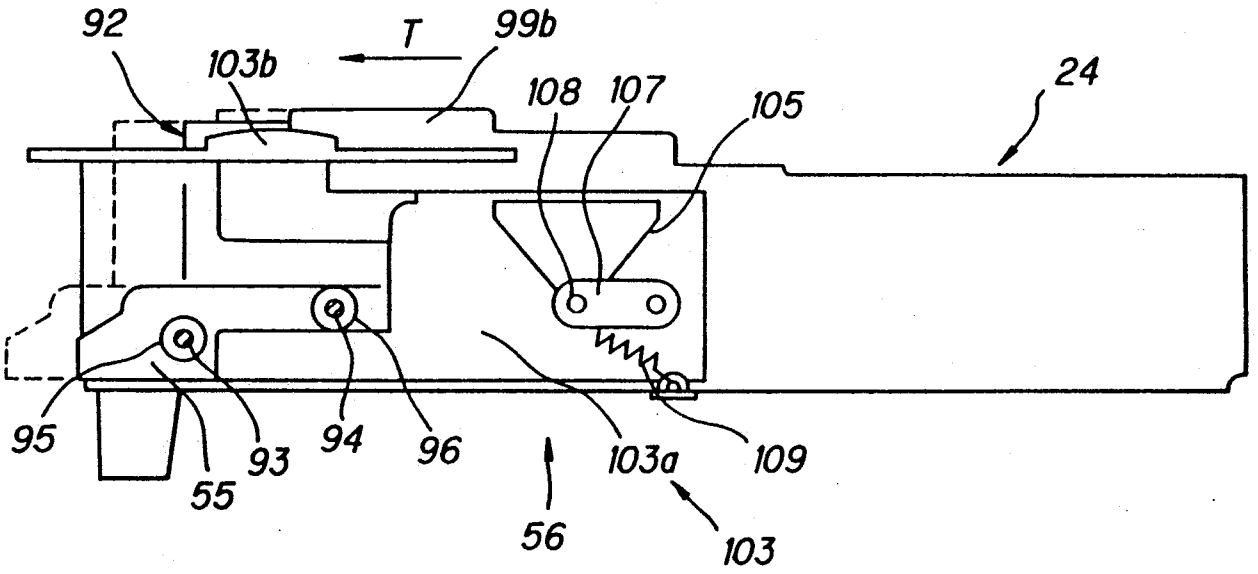
FIG. 15 is a side sectional view of the image formation apparatus with the lower coupling means switched to the second press position by the switch mechanism.

The switch lever 103 is partially provided with an inverted triangle-shaped notch 105 as shown in FIGS. 13 and 15. The notch 105 restricts a movement range of the switch lever 103 by engaging with a pivoting strip (restricting bar) 107. The pivoting strip 107 is pivotably mounted about an axis of a projecting member 108 on the upper frame 24 at one end of the pivoting strip 107. A spring 109 can bias the projecting member 108 of the pivoting strip 107 downwardly. The pivoting strip 107 is stabilized at the lowest point of the inverted triangle, i.e., the notch 105. Thus, the notch 105 can locate the switch lever 103 at either point in the direction P or Q.

Preferably, the pressing strip 55 has an inclined end corresponding to the taper surface 104 of the switch lever 103 to contact with the switch lever 103.

In the image formation apparatus having the above construction, generally, the upper coupling strip 51 is engaged with the pin 62 of the lower frame 23 as shown in FIG. 6. The lower coupling means 53 is engaged with the pin 81 of the lower frame 21 as shown in FIG. 9. Accordingly, the upper, intermediate and lower frames 24, 23, 21 are fixed in the closed conditions, respectively. In this condition, the holder 68 for the upper releasing means 52 is set in an upper position C, as shown in FIG. 6, by contacting at the lower end thereof with an upper wall 111 of the lower frame 21.

The upper frame 24 is independently opened when exchanging each consumable image formation unit 5, i.e., the photosensitive drum unit 6, the developer unit 7 or the fixing unit 9. The exchange operation may be performed as follows. As shown in FIG. 12, the main switch lever 103*a* moves in the direction P in response to movement of the manual control knob 103*b* of the switch lever 103 in the direction P. Consequently, the pressing strip 55 is loaded by the spring 101 in the direction S, and guided to the taper surface 104 of the switch lever 103. As a result, the pressing strip 55 horizontally moves to the first press position S1. If, in this condition, pulling the releasing lever 99*a* in the direction T, the pressing strip 55 is transferred in the direction T since the pressing strip 55 is integrally mounted with the opening/closing lever unit 92. Accordingly, the pressing strip 55 in the position Ts presses a contact maker 67 of the upper releasing means 52 to pivot the contact maker 67 about the lateral axis 66 as shown in FIG. 5. An upper end of the contact maker 67 outwardly presses an upper end of the pivoting member 65 to pivot the pivoting member 65 in the direction L2. The contact pad 71 of the pivoting member 65 pushes the engaging claw 63 of the upper coupling strip 51 in the direction L1 to release the engaging claw 63 from the pin 62. If pulling up the upper frame 24, the upper frame 24 is pivoted at right angle on the spindle 22. Since the upper frame 24 is set in the opened condition, the photosensitive drum unit 6, the developer unit 7 and fixing unit 9 come in sight as shown in FIG. 3.

The photosensitive drum unit 6, the developer unit 7 and fixing unit 9 can be upwardly pulled out of the image formation apparatus body 1, and exchanged for new parts.

It has been difficult to pick the fixing unit out of the conventional apparatus. In the present invention, however, the fixing unit 9 can be upwardly pulled as in the case of the developer unit 7 and the photosensitive drum unit 6. Additionally, exchange operation for these units is very easy.

When the transfer paper 11 is jammed in the carrying route 20 during image formation, an action for paper jam can be performed after opening the upper frame 24 coupled with the intermediate 23. Namely, the main switch lever 103*a* is moved in the direction Q by pressing the manual control knob 103*b* of the switch lever 103 in the direction Q as shown in FIGS. 14 and 15. Consequently, the pressing strip 55 contacts with the taper surface 104 of the switch lever 103 to horizontally move to the second press position S2 against the loaded spring 101. If, in this condition, pulling the releasing lever unit 92 in the direction T, a pointed end of the pressing strip 55 outwardly pushes the lower releasing strip 54. The lower releasing strip 54 is pivoted on the lateral axis 91 as shown in FIG. 10. The lower releasing strip 54 outwardly pushes the upper end of the holder 84 so that the holder 84 is pivoted on the lateral axis 88 in the direction L4. The lower end of the holder 84 inwardly moves the upper end of the engaging member 83 which is linked with the holder 84. The engaging member 83 is pivoted on the lateral axis 87 in the direction R3. The engaging claw 86 is separated from the pin 81, whereby the intermediate frame 23 can be released from the lower frame 21.

The upper and intermediate frames 24, 23 are pulled up and pivoted on the spindle 22 at approximately 30 degrees. Thus, the carrying route 20 is exposed on the upper surface of the lower frame 21. The intermediate and upper frames 23, 24 are integrally opened by the upper coupling strip 51.

The action for paper jam is performed in a condition where the intermediate and upper frames 23, 24 are integrally pulled up. If the intermediate frame 23 is possibly separated from the upper frame 24, there is the danger of the intermediate frame 23 dropping on the operator during operation on the transfer paper carrying route 20. For this, as shown in FIGS. 6 and 7, it is essential that the upper coupling strip 51 can not release the upper frame 24 from the intermediate frame 23 unless the carrying route 20 is closed under the intermediate frame 23. The upper coupling strip 51 should release the upper frame 24 only when the lower end of the holder 68 for the upper releasing means 52 contacts with the upper wall 111 of a PCU cover of the lower frame 21 and moves upwardly to be in the upper position C, i.e., only when the upper end of the upper releasing means 52 is pulled up to the same height as that of the pressing strip 55. That is, when the intermediate frame 23 is separated from the lower frame 21 as shown in FIG. 8, the holder 68 for the upper releasing means 52 is separated from the upper wall 111 of the lower frame 21. Consequently, the spring 74 biases the holder 68 to move downwardly, and the upper end of the contact maker 67 is also transferred below the height (a movement locus) of the pressing strip 55. As a result, it becomes impossible to release the upper coupling strip 51.

The image formation apparatus body 1, as described above, has frame open mechanisms which is switchable according to operation for exchange of the image formation units 5 or occurrence of paper jam. In exchange of the fixing unit 9, it is very easy to pull and mount the fixing unit 9 simply by pulling up the upper frame 24 at right angle. In the action for paper jam, it is very easy to remove a jammed paper since the transfer paper carrying route is completely exposed. Further, the switch mechanism 56 is an alternative switch which results in preventing a concomitant release of the upper releasing means 52 from lower releasing strip 54.

In addition, the upper releasing means 52 is vertically movable so that the upper releasing means 52 moves downwardly when the intermediate frame 23 coupled with the upper frame 24 is pulled up. Thus, the upper releasing means 52 never contacts with the pressing strip 55.

As described hereinabove, it is possible to avoid the danger of the intermediate frame 23 dropping on the operator during paper jam operation with the transfer paper carrying route 20 exposed. Therefore, a safe operation can be performed for paper jam.

The present invention has been described with respect to an embodiment applied to a laser beam printer with reference to the drawings. However, it must be noted that the present invention should not be limited to the embodiment, and many modifications and changes of the embodiment may be made without departing from the scope of the invention.

The present invention may be applied, for example, to a copying machine other than the laser beam printer.

As is apparent from the foregoing, the image formation apparatus according to the invention comprises the upper releasing means and lower releasing strip horizontally disposed in parallel with each other. The switch mechanism for switching the pressing strip between the side of the upper releasing means and the side of the lower releasing strip. Therefore, the switch mechanism allows to couple the intermediate frame with one of the upper frame and the lower frame according to each operation for, e.g., exchange of the fixing unit or occurrence of the paper jam. Thus, the operation can be easily performed.

The image formation apparatus further comprises the holder vertically movably provided for the intermediate frame, and the contact maker held by the holder. The holder and contact maker serve as the upper releasing means of the first opening/closing mechanism. Accordingly, the contact maker can be transferred below the movement locus of the pressing strip when the intermediate frame is released from the lower frame. As a result, the invention has some superior effects such that, since the pressing strip never contacts with the upper releasing means, it is possible to avoid the danger of the intermediate frame dropping during paper jam operation for paper carrying route.

What is claimed is:

1. An image formation apparatus comprising an image formation apparatus body including:

a lower frame having a transfer paper carrying route and a removable fixing unit;

an upper frame pivotably supported about a spindle to open and close with respect to said lower frame; and an intermediate frame pivotably supported about the spindle between said upper frame and said transfer paper carrying route, and having removable image formation units; said image formation apparatus further comprising:

a first opening/closing mechanism for opening and closing said upper frame with respect to said intermediate frame; and a second opening/closing mechanism for opening and closing said intermediate frame with respect to said lower frame;

said first opening/closing mechanism including an upper coupling strip for coupling said upper frame with said intermediate frame, and an upper releasing means for releasing said upper frame from said intermediate frame in response to contact with said upper coupling strip;

said second opening/closing mechanism including a lower coupling means for coupling said lower frame with said intermediate frame, and a lower releasing means for releasing said lower frame from said intermediate frame in response to contact with said lower coupling strip;

said upper releasing means and said lower releasing strip horizontally disposed in parallel with each other;

said upper frame having a shared pressing strip actuating said upper releasing means and lower releasing strip;

said pressing strip movably mounted in a direction to actuate said respective opening/closing mechanisms, and being switchable between a first press position to press said upper releasing means and a second press position to press said lower releasing strip; and a switch mechanism for switching said press strip to one of two positions.

2. An image formation apparatus according to claim 1, wherein said upper releasing means of said first opening/closing mechanism comprises:

a holder vertically movably mounted on said intermediate frame, and downwardly projecting in response to a spring when said intermediate frame is released; and a contact maker pivotably supported about an axis by said holder, and actuating said upper coupling strip in an uncoupling direction in response to press motion of said pressing strip, said contact maker is transferred below a movement locus of said pressing strip when said intermediate frame is released from said lower frame.

* * * * *